US011633783B2

(12) United States Patent
Kwon

(10) Patent No.: US 11,633,783 B2
(45) **Date of Patent: *Apr. 25, 2023**

(54) METHOD OF MANUFACTURING BILLET FOR PLASTIC WORKING FOR PRODUCING COMPOSITE MEMBER, AND BILLET MANUFACTURED THEREBY

(71) Applicant: Pukyong National University Industry-University Cooperation Foundation, Busan (KR)

(72) Inventor: Hansang Kwon, Busan (KR)

(73) Assignee: PUKYONG NATIONAL UNIVERSITY INDUSTRY-UNIVERSITY COOPERATION FOUNDATION, Busan (KR)

( * ) Notice: Subject to any disclaimer, the term of this patent is extended or adjusted under 35 U.S.C. 154(b) by 502 days.

This patent is subject to a terminal disclaimer.

(21) Appl. No.: 16/427,909

(22) Filed: May 31, 2019

(65) Prior Publication Data

US 2020/0324343 A1 Oct. 15, 2020

(30) Foreign Application Priority Data

Apr. 15, 2019 (KR) ..... 10-2019-0043557

(51) Int. Cl.
*B22F 7/02* (2006.01)
*B22F 3/02* (2006.01)
(Continued)

(52) U.S. Cl.
CPC ..... *B22F 7/02* (2013.01); *B22F 3/02* (2013.01); *B22F 3/105* (2013.01); *B22F 9/04* (2013.01);
(Continued)

(58) Field of Classification Search
CPC ..... B22F 7/008; B22F 7/02; B22F 7/04–2007/042; B22F 7/08
See application file for complete search history.

(56) References Cited

U.S. PATENT DOCUMENTS 3,285,786 A * 11/1966 Katz ..... H01L 35/34 136/205
4,154,893 A * 5/1979 Goldman ..... B29B 11/10 428/375
(Continued)

FOREIGN PATENT DOCUMENTS

CN 103602843 A * 2/2014
CN 105734322 A * 7/2016
(Continued)

OTHER PUBLICATIONS

K. Dasom., et al.; "Carbon nanotubes-reinforced aluminum alloy functionally graded materials fabricated by powder extrusion process", Materials Science & Engineering, 745, 2019, p. 379-389 (Year: 2019).*
(Continued)

*Primary Examiner* — Alexandra M Moore
*Assistant Examiner* — Austin Pollock
(74) *Attorney, Agent, or Firm* — Harness, Dickey & Pierce, P.L.C.

(57) ABSTRACT

Disclosed are a method of manufacturing a billet used in plastic working for producing a composite member and a billet manufactured by the method. The method includes (A) ball-milling powders of two more materials to prepare a composite powder and (B) preparing a multi-layered billet containing the composite powder. The multi-layered billet includes a core layer and two or more shell layers. The shell layers except for the outermost shell layer are made of the composite powder. The outermost shell layer is made of a pure metal or metal alloy. The composite powders contained
(Continued)

in the core layer and each of the shell layers have different compositions. The method has an advantage of manufacturing a plastic working billet being capable of overcoming the limitation of a single-material billet and enabling production of a characteristic-specific composite member such as a clad member.

2 Claims, 5 Drawing Sheets

(51) Int. Cl.
*B22F 3/105* (2006.01)
*B22F 9/04* (2006.01)

(52) U.S. Cl.
CPC ... *B22F 2009/043* (2013.01); *B22F 2301/052* (2013.01); *B22F 2302/40* (2013.01)

(56) References Cited

U.S. PATENT DOCUMENTS

2004/0020260 A1* 2/2004 Jin ..... B21C 25/04 72/260
2007/0134496 A1* 6/2007 Katagiri ..... F28F 21/02 428/408
2010/0290943 A1* 11/2010 Lee ..... C22C 26/00 241/15
2011/0068299 A1* 3/2011 Hong ..... C22C 26/00 252/182.33
2012/0152480 A1* 6/2012 Nayfeh ..... B82Y 30/00 164/61
2012/0164429 A1* 6/2012 Shah ..... B82Y 30/00 428/293.1
2012/0267141 A1* 10/2012 Kamiyama ..... C22C 47/062 174/102 R
2016/0279709 A1* 9/2016 Xu ..... B22F 7/02
2019/0006127 A1* 1/2019 Rodriguez Salinas ..... B22F 1/0025
2019/0122783 A1* 4/2019 Otsuka ..... C22C 21/00

FOREIGN PATENT DOCUMENTS

CN 109338167 A * 2/2019
JP S61190006 A * 8/1986
KR 10-2010-0066089 A 6/2010
KR 20130028378 A * 3/2013
KR 20140076448 A * 6/2014
KR 101590181 B1 1/2016
KR 20160019711 A * 2/2016
KR 101686973 B1 * 12/2016
KR 101822073 B1 * 1/2018

OTHER PUBLICATIONS

Kwon H. et al., "Fabrication of Functionally Graded Carbon Nanotube-Reinforced Aluminum Matrix Composite", Advanced Engineering Materials, 13, No. 4, 2011, p. 325-329 (Year: 2011).*
Kwon H., et al. "Extrusion of Spark Plasma Sintered Aluminum-Carbon Nanotube Composites at Various Sintering Temperatures", J. of Nanoscience and Nanotechnology, vol. 9, p. 6542-6548, 2009 (Year: 2009).*
Kwon H. et al. "Combination of hot extrusion and spark plasma sintering for producing carbon nanotube reinforced aluminum matrix composites", Carbon, 570-577, 2009 (Year: 2009).*
Yamamoto G., et al.; "A novel structure for carbon nanotube reinforced alumina composites with improved mechanical properties", Nanotechnology, vol. 19, 2008 (Year: 2008).*
Yuuki J., et al.; "Fabrication of Carbon Nanotube Reinforced Aluminum Composite by Powder Extrusion Process", J. Japan Society of Powder Metallurgy, vol. 54, No. 9 (Year: 2007).*

* cited by examiner

METHOD OF MANUFACTURING BILLET FOR PLASTIC WORKING FOR PRODUCING COMPOSITE MEMBER, AND BILLET MANUFACTURED THEREBY

CROSS REFERENCE TO RELATED APPLICATION

The present application claims priority to Korean Patent Application No. 10-2019-0043557 (filed Apr. 15, 2019), the entire contents of which is incorporated herein for all purposes by this reference.

BACKGROUND OF THE INVENTION

1. Field of the Invention

The present invention relates to a method of manufacturing a billet for plastic working and a billet manufactured by the method.

2. Background of the Invention

Plastic working is a process of forming a material into various shapes in large quantities without involving cutting such as machining. In particular, it can easily and simply make a shape close to the final product simply in a solid state without melting by using a mold or a frame having a desired shape.

However, since a material of a billet used in conventional plastic working is limited to a single material, development of a billet manufacturing technique suitable for manufacturing a composite material through plastic working is required.

LITERATURE OF RELATED ART

Patent Literature (Patent Literature 1) Korean Patent No. 10-1590181 (Jan. 25, 2016)

(Patent Literature 2) critical No. 10-0066089 (Jun. 17, 2010)

SUMMARY OF THE INVENTION

An object of the present invention is to provide a method of manufacturing a billet for plastic working for producing a composite member such as a clad member through a plastic working process such as extrusion, and a billet produced thereby.

In order to accomplish the objects of the invention, according to one aspect of the invention, there is provided a method of manufacturing a billet used in plastic working for producing a composite member, the method including (A) ball-milling powders of two more materials to prepare a composite powder and (B) preparing a multi-layered billet containing the composite powder, wherein the multi-layered billet includes a core layer and two or more shell layers, the shell layers except for the outermost shell layer are made of the composite powder, the outermost shell layer is made of a pure metal or metal alloy, and the composite powders contained in the core layer and each of the shell layers have different compositions.

The two or more materials may be selected from the group consisting of metal, polymer, ceramic, and carbon-based nano materials.

The metal may be any one metal or a metal alloy of two or more metals selected from the group consisting of Al, Cu, Ti, Mg, K, Ca, Sc, V, Cr, Mn, Fe, Co, Ni, Zn, Ga, Rb, Sr, Y, Zr, Mo, Ru, Rh, Pd, Ag, Cd, In, Sn, Cs, Ba, La, Ce, Nd, Sm, Eu, Gd, Tb, W, Cd, Sn, Hf, Ir, Pt, and Pb.

The polymer may be (i) a thermoplastic resin selected from the group consisting of an acrylic resin, an olefin resin, a vinyl resin, a styrene resin, and a fluorine resin, or (ii) a thermosetting resin selected from the group consisting of an epoxy resin and a polyimide resin.

The ceramic may be (i) an oxide ceramic or (ii) any one non-oxide ceramic selected from the group consisting of nitrides, carbides, borides, and silicides.

The carbon nanomaterial may be at least one selected from the group consisting of carbon nanotubes, carbon nanofibers, carbon nanoparticles, mesoporous carbon, carbon nanosheets, carbon nanorods, and carbon nanobelts.

The multi-layered billet may include a core layer, a first shell layer surrounding the core layer, and a second shell layer surrounding the first shell layer.

The multi-layered billet may include a first billet serving as the second shell layer and has a can shape, a second billet serving as the first shell layer and disposed inside the first billet, and a third billet serving as the core layer and disposed inside the second billet.

In the step (B), the preparing of the multi-layered billet may include compressing the composite powder at a high pressure of 10 to 100 MPa.

In the step (B), the preparing of the billet may include subjecting the composite powder to spark plasma sintering performed at a pressure of 30 to 100 MPa and a temperature of 280° C. to 600° C. for a duration of 1 second to 30 minutes.

According to another aspect of the invention, there is provided a billet used in plastic working for producing a composite member, the billet being manufactured by the method described above.

The method according to the present invention has an advantage of producing a plastic working billet capable of overcoming the limitations of a conventional single-material billet and enabling production of a characteristic-specific composite member such as a clad member billet.

DESCRIPTION OF EMBODIMENTS OF THE INVENTION

Figure 1:
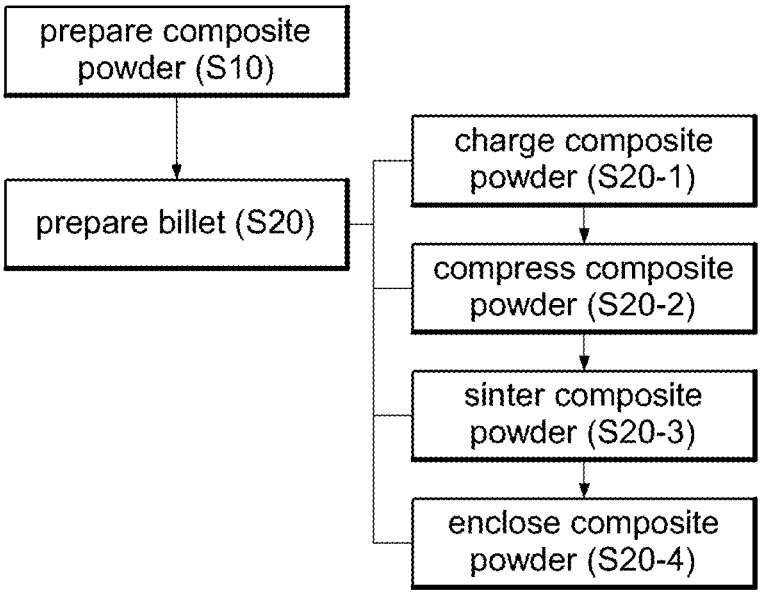
FIG. 1 is a flowchart of a method of manufacturing a billet for plastic working for producing a composite member according to the present invention.

In describing embodiments of the present invention, well-known functions or constructions will not be described in detail when they may obscure the gist of the present invention.

Embodiments in accordance with the concept of the present invention can undergo various changes to have various forms, and only some specific embodiments are illustrated in the drawings and described in detail in the present disclosure. While specific embodiments of the present invention are described herein below, they are only for illustrative purposes and should not be construed as limiting the present invention. Accordingly, the present invention should be construed to cover not only the specific embodiments but also cover all modifications, equivalents, and substitutions that fall within the concept and technical spirit of the present invention.

The terminology used herein is for the purpose of describing particular embodiments only and is not intended to limit the scope of the present invention. As used herein, the singular forms "a", "an," and "the" are intended to include the plural forms as well unless the context clearly indicates otherwise. It will be further understood that the terms "comprises", "includes", or "has" when used in the present disclosure specify the presence of stated features, regions, integers, steps, operations, elements and/or components, but do not preclude the presence or addition of one or more other features, regions, integers, steps, operations, elements, components and/or combinations thereof.

Hereinafter, embodiments of the present invention will be described.

FIG. 1 is a flowchart of a method of manufacturing a billet for plastic working for producing a composite member according to one embodiment of the present invention.

Hereinafter, a method of manufacturing a billet for plastic working for producing a composite member will be described with reference to FIG. 1.

Referring to FIG. 1, a method of manufacturing a billet for plastic working for producing a composite member includes a composite powder preparation step S10 of preparing a composite powder by ball-milling powders of two or more kinds of materials, and a billet preparation step S20 of preparing a multi-layered billet including the composite powder.

First, a composite powder is produced by ball-milling powders of two or more kinds of materials in step S10.

In this case, the two or more materials are selected from the group consisting of metal, polymer, ceramic, and carbon-based nano materials.

The metal is any one metal or an alloy of two or more metals selected from the group consisting of Al, Cu, Ti, Mg, K, Ca, Sc, V, Cr, Mn, Fe, Co, Ni, Zn, Ga, Rb, Sr, Y, Zr, Mo, Ru, Rh, Pd, Ag, Cd, In, Sn, Cs, Ba, La, Ce, Nd, Sm, Eu, Gd, Tb, W, Cd, Sn, Hf, Ir, Pt, and Pb.

The polymer is (i) a thermoplastic resin selected from the group consisting of an acrylic resin, an olefin resin, a vinyl resin, a styrene resin, and a fluorine resin, or (ii) a thermosetting resin selected from the group consisting of an epoxy resin and a polyimide resin. However, the polymer is not limited thereto.

The ceramic is (i) an oxide ceramic or (ii) any one of non-oxide ceramics, selected from the group consisting of nitrides, carbides, borides, and silicides.

The carbon nanomaterial is at least one selected from the group consisting of carbon nanotubes, carbon nanofibers, carbon nanoparticles, mesoporous carbon, carbon nanosheets, carbon nanorods, and carbon nanobelts. However, the carbon nanomaterial is not limited thereto.

On the other hand, recycled powder may be used as each of the powders of the two or more kinds of materials.

For example, aluminum or aluminum alloy powder, and carbon nanotubes (CNT) are ball-milled to produce a composite powder.

The aluminum alloy powder is powder of any one aluminum alloy selected from the group consisting of 1000 series, 2000 series, 3000 series, 4000 series, 5000 series, 6000 series, 7000 series and 8000 series.

Since the composite powder includes the carbon nanotubes, when a composite member such as a clad member is produced through plastic working such as extrusion, rolling, and forging by using a billet made from the composite powder, the composite member has high thermal conductivity, high strength, and light weight. Therefore, the composite member produced thus can be very usefully utilized as heat dissipation members for various electronic parts and lighting devices.

When preparing the composite powder, there are problems that micro-sized aluminum or aluminum alloy particles are difficult to disperse due to a large size difference from nano-sized carbon nanotubes and the carbon nanotubes easily agglomerate by a strong Van der Waals force. Therefore, a dispersion agent is added to uniformly blend the carbon nanotubes and the aluminum particles or aluminum alloy particles.

The dispersion agent is a nano-sized ceramic selected from the group consisting of nano-SiC, nano-$SiO_2$, nano-$Al_2O_3$, nano-$TiO_2$, nano-$Fe_3O_4$, nano-MgO, nano-$ZrO_2$ and mixtures thereof.

The nano-sized ceramic particles uniformly disperse the carbon nanotubes among the aluminum particles or aluminum alloy particles. Since the nano-sized silicon carbide (SiC) has high tensile strength, sharpness, constant electrical conductivity, constant thermal conductivity, high hardness, high fire resistance, high resistance to a thermal shock, high chemical stability at high temperatures, it is widely used as an abrasive or a fireproofing agent. In addition, the nano-sized SiC particles present on the surfaces of the aluminum particles have a function of preventing direct contact between the carbon nanotubes and the aluminum particles or aluminum alloy particles to inhibit formation of undesirable aluminum carbide which is formed through reaction between the carbon nanotubes and the aluminum particles or aluminum alloy particles.

In addition, the composite powder may include 100 parts by volume of the aluminum powder or aluminum alloy powder and 0.01 to 10 parts by volume of the carbon nanotubes.

When the content of the carbon nanotubes is less than 0.01 part by volume with respect to 100 parts by volume of the aluminum powder or aluminum alloy powder, the strength of an aluminum-based clad member made from the composite powder is similar to that of a pure aluminum clad member or an aluminum alloy clad member. That is, in that range of the content of the carbon nanotubes, the composite power cannot play a role as a reinforcing material. Conversely, when the content exceeds 10 parts by volume, there is a disadvantage in that an elongation decreases although the strength of an aluminum-based clad member made from the composite power is higher than that of a pure aluminum or aluminum alloy clad member. In addition, when the content of the carbon nanotubes is excessively large, the carbon nanotubes hinder dispersion of the aluminum particles and degrade mechanical and physical properties of the product by serving as defect sites.

When the dispersion agent is included in the composite powder, the composite powder contains 0.1 to 10 parts by volume of the dispersion agent with respect to 100 parts by volume of the aluminum powder.

When the content of the dispersion agent is less than 0.1 part by volume with respect to 100 parts by volume of the aluminum powder, the dispersion inducing effect is insignificant. Conversely, when the content exceeds 10 parts by volume, the dispersion agent rather hinders dispersion of the aluminum particles because it causes the carbon nanotubes to agglomerate.

A horizontal or planetary ball mill is used for the ball milling. The ball milling is performed in a nitrogen or argon ambient at a low speed ranging from 150 to 300 rpm or a high speed of 300 or more rpm for a duration of 12 to 48 hours.

The ball milling begins by charging 100 to 1500 parts by volume of stainless steel balls (a 1:1 mixture of balls with a diameter of 10 mm and balls with a diameter of 20 mm) into a stainless steel container with respect to 100 parts by volume of the composite powder.

To reduce the coefficient of friction, any one organic solvent selected from the group consisting of heptane, hexane, and alcohol is used as a process control agent. In this case, the process control agent is added by 10 to 50 parts by volume with respect to 100 parts by volume of the composite powder. After the completion of the ball milling, the stainless steel container is opened so that the organic solvent can be volatilized, leaving only a mixture of the aluminum powder and the carbon nanotubes.

The dispersion agent (herein, nano-sized ceramic particles) plays the same role as nano-sized milling balls due to the rotational force generated during the ball milling, thereby physically separating the agglomerated carbon nanotubes from each other and improving the fluidity of the carbon nanotubes. Thus, the carbon nanotubes can be uniformly dispersed on the surfaces of the aluminum particles.

Next, a multi-layered billet is made from the obtained composite powder in step S20.

The multi-layered billet produced in this step includes a core layer and at least two shell layers surrounding the core layer. The shell layers except for the outermost shell layer are made of the composite powder. The outermost shell layer is made of a pure metal or an alloy thereof. The composite powders contained in the core layer and each of the shell layers have different compositions (i.e., include different materials or have a ratio of materials contained therein).

When the materials contained in the composite powder are aluminum (or aluminum alloy) and carbon nanotubes (CNT), the multi-layered billet produced in this step includes a core layer and at least two shell layers surrounding the core layer. The shell layers except for the outermost shell layer are made of the composite powder. The outermost shell layer is made of (i) the aluminum or aluminum alloy powder or (ii) the composite powder. The composite powders contained in the core layer and each of the shell layers have different volume parts of carbon nanotubes with respect to a predetermined volume part of the aluminum or aluminum alloy powder.

The number of the shell layers included in the multi-layered billet is not particularly limited, but it is preferably 5 or less in terms of cost efficiency.

Figure 2:
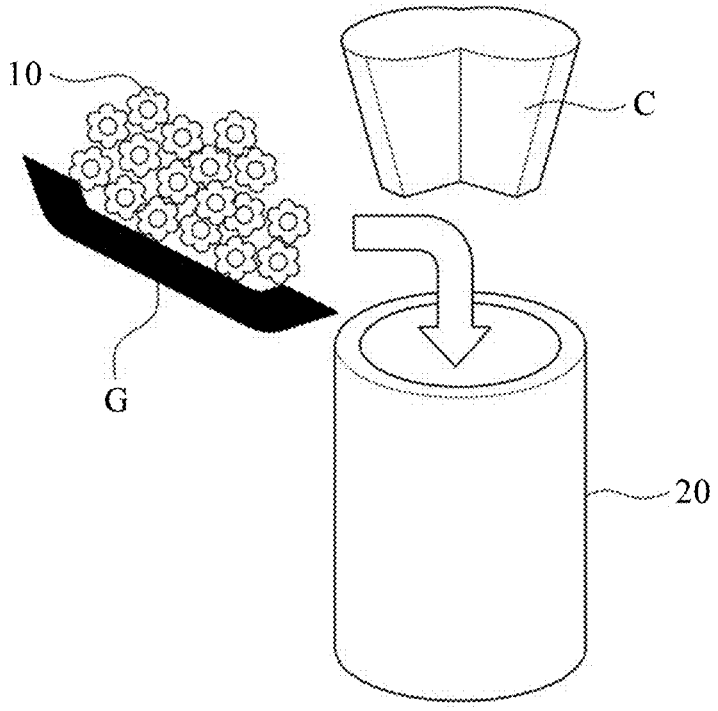
FIG. 2 is a diagram schematically illustrating a billet preparation process.

FIG. 2 is a diagram schematically illustrating a multi-layered billet preparation process. Referring to FIG. 2, the billet is prepared by charging the composite powder 10 into a metal can 20 through a guider G in step S20-1. The metal can 20 is closed with a cap C or the composite powder in the metal can 20 is compressed so that the composite power cannot flow out of the metal can 20 in step S20-4.

The metal can 20 is made of any metal being thermally and electrically conductive. Preferably, the metal can 20 is made of aluminum, copper, or magnesium. The thickness of the metal can 20 ranges from 0.5 to 150 mm when a 6-inch billet is used, but it varies depending on the size of the billet used.

Figure 3:
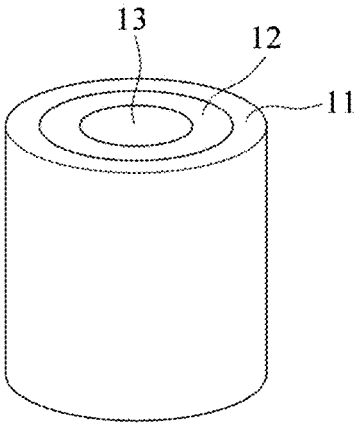
FIG. 3 is a perspective view schematically illustrating a multi-layered billet prepared in the method according to the present invention.

FIG. 3 is a diagram illustrating an example of the multi-layered billet. The example of the multi-layered billet includes a core layer and two shell layers surrounding the core layer. Specifically, the multi-layered billet includes a core layer, a first shell layer surrounding the core layer, and a second shell layer surrounding the first shell layer.

Referring to FIG. 3, a second billet 12 serving as the first shell layer is disposed in a first billet 11 having a hollow cylindrical shape, serving as the second shell layer (i.e., the outermost shell layer), and made of a material having a composition different from that of the second billet, and a third billet 13 having a composition different from that of the second billet 12 is disposed in the second billet 12 as the core layer to form the multi-layered billet.

The first billet 11 has a hollow cylindrical shape. That is, the first billet 11 is in the form of a can with one end closed or in the form of a hollow cylinder with both ends being open. The first billet 11 is made of aluminum, copper, magnesium, or the like. The first billet 11 having a hollow cylinder shape is manufactured by melting a base metal and injecting molten metal into a mold. Alternatively, it can be manufactured by machining a metal block.

The second billet 12 includes the prepared composite powder. The second billet 12 is in the form of a mass or powder.

When the second billet 12 is in the form of a mass, the second billet 12 specifically has a cylinder shape. The composite billet is prepared by placing the cylindrical second billet 12 in the first billet 11. To prepare the multi-layered billet in which the second billet 12 is placed in the first billet 11, the composite powder to form the second billet 12 is melted, the molten material is injected into a mold to form a cylindrical shape, and the cylindrical shape is press-fitted into the first billet 11. Alternatively, the composite powder is directly charged into the cavity of the first billet 11.

The third billet 13 is a metal mass or metal powder.

When the second billet 12, the third billet 13, or both are in the form of a mass of the composite powder, the mass of the composite powder is produced by compressing the composite powder at a high pressure or sintering the composite powder.

In this case, the composite powders included in the second billet 12 and the third billet 13 have different compositions. The materials contained in the composite powder are aluminum (or aluminum alloy) and carbon nanotubes (CNT), the composite powder of the second billet 12 contains 0.09 to 10 parts by volume of the carbon nanotubes with respect to 100 parts by volume of the aluminum or aluminum alloy powder, and the composite powder of the third billet 13 contains 0 to 0.08 part by volume of the carbon nanotubes with respect to 100 parts by volume of the aluminum or aluminum alloy powder.

Alternatively, the second billet 12 is made of the composite powder, and the third billet 13 is a metal mass or powder selected from the group consisting of aluminum, copper, magnesium, titanium, stainless steel, tungsten, cobalt, nickel, tin, and alloys thereof.

Of the total volume of the composite billet, the second billet accounts for 0.01 to 10 vol %, the third billet accounts for 0.01 to 10 vol %, and the first billet 11 accounts for the rest.

On the other hand, since the second billet or the third billet of the multi-layered billet is made of the composite powder, the multi-layered billet is compressed at a high pressure of 10 to 100 MPa in step S20-2 before being enclosed.

Since the multi-layered billet is compressed, it is possible to perform plastic working such as extrusion of the multi-layered billet using an extrusion die in the next step. When the pressure for compressing the composite powder is less than 10 MPa, there is a possibility that pores occur in the composite member produced through the plastic working and the composite powder flows down. When the pressure exceeds 100 MPa, the second billet (meaning second and onward billets) is likely to expand.

Further, since the second billet and/or the third billet of the multi-layered billet is made of the composite powder, a process of sintering the multi-layered billet is performed in step S20-3 to supply the multi-layered billet to plastic working such as extrusion.

A spark plasma sintering apparatus or a hot press sintering is used for the sintering in the invention. However, any sintering apparatus can be used as long as the same object can be achieved. However, when it is necessary to perform precise sintering in a short time, it is preferable to use discharge plasma sintering. In this case, discharge plasma sintering is performed at a temperature of 280 to 600° C. for a duration of 1 second to 30 minutes under a pressure of 30 to 100 MPa.

Hereinafter, the present invention will be described in detail with reference to examples.

Examples according to the present invention can be modified in various other forms, and the scope of the present invention is not construed as being limited to the examples described below. Examples are provided to more fully describe the present invention to the ordinarily skilled in the art.

EXAMPLE AND COMPARATIVE EXAMPLE: MULTI-LAYERED BILLET INCLUDING ALUMINUM AND CARBON NANOTUBE AND EXTRUDATE THEREOF

Example 1

Carbon nanotubes (manufactured by SCSiAl headquartered in Luxembourg) having a purity of 99.5%, a diameter of 10 nm or less, and a length of 30 μm or less were used. Aluminum powder (manufactured by MetalPlayer headquartered in Korea) having an average particle size of 45 μm and a purity of 99.8% was used.

A multi-layered billet was manufactured such that a third billet having a columnar shape was positioned at the center of a metal can serving as a first billet and a second billet (composite powder) was positioned between the first billet and the third billet.

The second billet included aluminum-CNT composite powder containing 0.1 part by volume of the carbon nanotube with respect to 100 parts by volume of the aluminum powder. The first billet was made of aluminum 6063, and the third billet was made of aluminum 3003.

The second billet was manufactured in manner described below. 100 parts by volume of the aluminum powder and 0.1 parts by volume of the carbon nanotubes were introduced into a stainless steel container to fill 30% of the total volume of the stainless steel. Stainless steel milling balls (a mixture of balls having a diameter of 20 mm and balls having a diameter of 10 mm) were introduced into the container by 30% of the total volume of the container, and 50 ml of heptane was added to the mixture in the stainless steel container. The mixture was ball-milled at a low speed of 250 rpm for 24 hours using a horizontal ball mill. After the completion of the ball milling, the container was opened to allow the heptane to be completely volatilized and the remaining aluminum-CNT composite powder was collected.

The aluminum-CNT composite powder thus prepared was charged into a gap 2.5 t between the first billet and the third billet and compressed at a pressure of 100 MPa to prepare the multi-layered billet.

Example 2

In the same manner as in Example 1, an aluminum-CNT composite powder containing the carbon nanotubes in a content of 1 part by volume was prepared and a multi-layered billet was prepared by using the composite powder.

Example 3

In the same manner as in Example 1, an aluminum-CNT composite powder containing the carbon nanotubes in a content of 3 parts by volume was prepared and a multi-layered billet was prepared by using the composite powder.

Example 4

Figure 4:
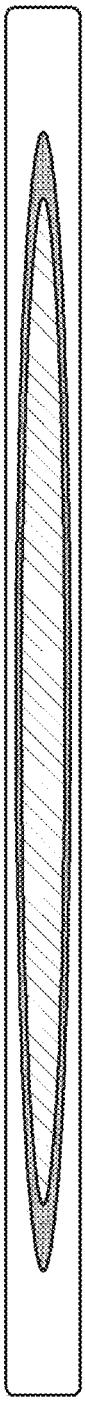
FIG. 4 is a photograph of a composite member produced by extruding an aluminum-based billet according to Example 4.

The multi-layered billet prepared in Example 1 was extruded directly using a direct extruder under the conditions of an extrusion ratio of 100, an extrusion rate of 5 mm/s, an extrusion pressure of 200 kg/cm$^2$, and a billet temperature of 460° C. to produce an aluminum-based clad member (see FIG. 4).

Example 5

The multi-layered billet prepared in Example 2 was extruded directly using a direct extruder under the conditions of an extrusion ratio of 100, an extrusion rate of 5 mm/s, an extrusion pressure of 200 kg/cm$^2$, and a billet temperature of 460° C. to produce an aluminum-based clad member.

Example 6

The multi-layered billet prepared in Example 3 was extruded directly using a direct extruder under the conditions of an extrusion ratio of 100, an extrusion rate of 5 mm/s, an extrusion pressure of 200 kg/cm$^2$, and a billet temperature of 460° C. to produce an aluminum-based clad member.

Comparative Example 1

A mixture of CNT 10 wt % and aluminum powder 80 wt. % was blended with a dispersion agent (a 1:1 mixture of a solvent and a natural rubber solution) at a blending ratio of 1:1 and then exposed to ultrasonic waves for 12 minutes to prepare a dispersion mixture. The dispersion mixture was heat-treated in an inert atmosphere at a temperature of 500° C. in a tubular furnace for 1.5 hours. Through the heat treatment, the dispersion agent was completely removed (volatilized), leaving only an aluminum-CNT mixture. The aluminum-CNT composite powder thus prepared was charged into an aluminum can having a diameter of 12 mm and a thickness of 1.5 mm and then the aluminum can was capped to produce a billet.

Comparative Example 2

Figure 5:
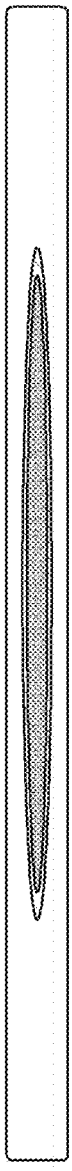
FIG. 5 is a photograph of a composite member produced by extruding an aluminum-based billet according to Comparative Example 2.

The billet produced in Comparative Example 1 was hot-extruded with a hot extruder (model UH-500 kN, Shimadzu Corporation, Japan) at an extrusion temperature of 450° C. and an extrusion ratio of 20 to produce an aluminum clad member (see FIG. 5).

Experimental Example 1: Measurement of Mechanical Properties of Aluminum-Based Clad Member The tensile strength, elongation, and Vickers hardness of the aluminum-based clad members prepared according to Examples and Comparative Examples were measured, and the results are shown in Table 1.

The tensile strength and elongation were measured according to the Korean Industrial Standard (KS), under test conditions of a tensile speed of 2 mm/s. Test specimens were prepared according to KS B0802 No. 4 (test specimen). The Vickers hardness was measured under conditions of 300 g and 15 seconds.

TABLE 1

| | Tensile Strength (MPa) | Elongation (%) | Vickers Hardness (Hv) |
|---|---|---|---|
| Example 4 | 165 | 21 | 38 |
| Example 5 | 203 | 18 | 68 |
| Example 6 | 195 | 15 | 60 |
| Comparative Example 2 | 190 | 10 | 100 |
| Al6063[1)] | 120 | 28 | 30 |
| Al3003[2)] | 100 | 31 | 28 |

[1)]Al6063: aluminum 6063
[2)]Al3003: aluminum 3003

Referring to Table 1, the aluminum-based clad members according to Examples 4 to 6 had high strength and high ductility as compared with the aluminum-based clad member made from a rigid material (Al6063) and a soft material (Al3003).

The aluminum-based clad member according to Comparative Example 2 had a high Vickers hardness but a very low elongation.

Experimental Example 2: Measurement of Corrosion Resistance of Aluminum-Based Clad Member The corrosion resistance characteristics of the aluminum-based clad members according to Example 5 and Comparative Example 2 were measured, and the results are shown in Table 2.

The corrosion resistance characteristics were measured by a seawater spraying method for specimens with a size of 10×10 and a thickness of 2 mm according to the CASS standard.

TABLE 2

| | CASS Corrosion Resistance | Conductivity (W · m−1 · K−1) |
|---|---|---|
| Example 5 | 400 or more | 268 |
| Comparative Example 2 | 320 | 210 |
| Al6063[1)] | 200 | 194 |
| Al3003[2)] | 300 | 190 |

[1)]Al6063: Aluminum 6063
[2)]Al3003: Aluminum 3003

Referring to Table 2, the aluminum-based clad member prepared according to Example 5 exhibited improved corrosion resistance even with a small amount of CNT added, as compared to the aluminum-based clad members made from a rigid material (A6063) and an anti-corrosive material (A3003). In addition, the aluminum-based clad member in Comparative Example 2 exhibited a higher value than the pure metal alloy but exhibited a lower value than the aluminum-based clad member in Example 5.

Experimental Example 3: Measurement of Thermal Conductivity of Aluminum-Based Clad Member The density, heat capacity, diffusivity, and thermal conductivity of the aluminum-based clad members prepared according to Example 6 and Comparative Example 2 were measured and the results are shown in Table 3 below.

The density of the aluminum-based clad member was measured on the principle of Archimedes according to the ISO standard. The heat capacity and diffusivity were measured by using a laser flash method using a specimen having a size of 10×10 and a thickness of 2 mm. The thermal conductivity was obtained as the product of measured density×heat capacity×diffusivity.

TABLE 3

| | Density ($g/cm^3$) | Heat Capacity (j/g · K) | Diffusivity($mm^3/s$) | Conductivity ($W \cdot m^{-1} \cdot K^{-1}$) |
|---|---|---|---|---|
| Example 6 | 2.69 | 0.788 | 148 | 294 |
| Comparative Example 2 | 2.7 | 1.1 | 84 | 250 |
| Al6063[1)] | 2.7 | 0.9 | 80 | 194 |
| Al1005[2)] | 2.7 | 0.9 | 95 | 230 |
| SWCNT[3)] | 1.8 or less | 0.7 | 460 | 5500 or less |

[1)]Al6063: aluminum A6063
[2)]Al: aluminum Al1005
[3)]SWCNT: single-walled carbon nanotube Referring to Table 3, the aluminum-based clad member prepared according to Example 6 exhibited improved thermal conductivity even with a small amount of CNT added, as compared to the aluminum-based clad members made from a rigid material (A6063) and a soft high-conductivity pure aluminum (Al005).

In addition, the aluminum-based clad member in Comparative Example 2 exhibited a higher value than the pure metal alloy but exhibited a lower value than the aluminum-based clad member in Example 6.

While the present invention has been illustrated and described with reference to exemplary embodiments thereof, it is to be understood by those skilled in the art that the present invention is not limited to the disclosed exemplary embodiments but rather various modifications and improvements are possible without departing from the basic concept of the present invention. Thus, it should be understood that the modifications, improvements, and equivalents also fall within the scope of the present invention defined by the appended claims.

What is claimed is:

1. A method of manufacturing a billet for plastic working for producing a composite member, the method comprising:

(A) ball-milling aluminum powder and carbon nanotubes (CNT) to produce a plurality of composite powders; and (B) preparing a multi-layered billet using the plurality of composite powders, wherein in the step (B), the preparing of the multi-layered billet comprises subjecting the composite powder to spark plasma sintering performed at a pressure of 30 to 100 MPa and a temperature of 280° C. to 600° C. for a duration of 1 second to 30 minutes, wherein the multi-layered billet comprises a first billet having a can shape and serving as a second shell layer; a second billet disposed inside the first billet as a first shell layer; and a third billet disposed inside the second billet as a core layer, wherein the first billet is made of aluminum, and the second billet comprises one of the plurality of composite powders and the third billet comprise another one of the plurality of the composite powders, and wherein the second billet comprises 0.09 to 10 parts by volume of the carbon nanotubes with respect to 100 parts by volume of the aluminum powder, and the third billet comprises 0.08 part by volume of the carbon nanotubes with respect to 100 parts by volume of the aluminum powder.

2. A multi-layered billet used in plastic working for producing a composite member, the multi-layered billet comprising a first billet having a can shape and serving as a second shell layer; a second billet disposed inside the first billet as a first shell layer; and a third billet disposed inside the second billet as a core layer, wherein the first billet is made of aluminum, the second billet comprises 0.09 to 10 parts by volume of carbon nanotubes with respect to 100 parts by volume of an aluminum powder, and the third billet comprises 0.08 part by volume of carbon nanotubes with respect to 100 parts by volume of the aluminum powder, wherein the multi-layered billet is manufactured by the method of claim 1.

* * * * *